United States Patent [19]

Funk

[11] 4,070,232

[45] Jan. 24, 1978

[54] PREHYDROLYSIS AND DIGESTION OF PLANT MATERIAL

[76] Inventor: Harald F. Funk, 68 Elm St., Murray Hill, N.J. 07974

[21] Appl. No.: 582,349

[22] Filed: May 30, 1975

Related U.S. Application Data

[63] Continuation-in-part of Ser. No. 442,821, Feb. 15, 1974, abandoned.

[51] Int. Cl.[2] ..... D21C 1/04; C13K 13/00

[52] U.S. Cl. ..... 162/16; 127/37; 162/73; 162/76; 162/84; 162/85; 162/86; 162/89; 162/90; 162/96; 162/97; 162/99

[58] Field of Search ..... 162/16, 14, 70, 73, 162/76, 89, 90, 96, 97, 99, 63, 64, 66, 84, 85, 86, 88; 127/37

[56] References Cited

U.S. PATENT DOCUMENTS

| | | | |
|---|---|---|---|
| 2,898,994 | 8/1959 | Thomsen | 162/96 X |
| 2,944,929 | 7/1960 | Knapp et al. | 162/96 X |
| 2,992,155 | 7/1961 | Okuno | 162/96 X |
| 3,051,611 | 8/1962 | Falcon et al. | 162/96 X |
| 3,081,218 | 3/1963 | Ambuehl et al. | 162/96 X |
| 3,212,933 | 10/1965 | Hess et al. | 127/37 |
| 3,251,716 | 5/1966 | Porter | 127/37 |
| 3,479,248 | 11/1969 | Nobile | 127/37 X |
| 3,523,911 | 8/1970 | Funk et al. | 127/37 X |
| 3,738,908 | 6/1973 | Villavicencio | 162/96 X |
| 3,923,591 | 12/1975 | Villavicencio | 162/96 X |

*Primary Examiner*—Arthur L. Corbin
*Attorney, Agent, or Firm*—Stuart J. Friedman

[57] ABSTRACT

Plant material containing hemicellulose and lignin is prehydrolyzed in the presence of steam and the vapors of a dilute acid solution having a pH of 1.5–3.5 at a temperature of 105° C to 135° C for 7–20 minutes to hydrolyze the hemicellulose into pentoses and hexoses and to leave a fibrous material and a liquid, said liquid containing said pentoses and hexoses. The liquid is separated from the fibrous material, and the pentoses and hexoses are recovered from the liquid. The fibrous material is digested with white liquor at a temperature of 105° C to 135° C.

13 Claims, No Drawings

PREHYDROLYSIS AND DIGESTION OF PLANT MATERIAL

CROSS REFERENCE TO RELATED APPLICATION

The present application is a continuation-in-part of application Ser. No. 442,821, filed Feb. 15, 1974, now abandoned.

BACKGROUND OF THE INVENTION

Wood has been the principal source of fibers for use in making paper since the beginning of that industry. The rapid increase in demand for paper and the resultant rapid depletion of the supply of wood together with the slow growth of trees has compelled the papermaking industry to look for other sources of fibers that could be used in paper manufacturing.

One possible new source which has been investigated for the past several decades is bagasse, which is what remains after a sweet watery liquid has been expressed from sugar cane, as by passing the cane between rollers. The expressed liquid contains a disaccharide which, after being purified and concentrated, is refined to commercial sugar. Bagasse has been used mainly as a fuel for heating in processes where the expressed liquid is concentrated and refined.

Bagasse consists of about 45% to 47% by weight of alpha cellulose, from about 25% to 30% by weight of hemicellulose in the form of beta- and gamma-cellulose and from about 23% to 25% by weight of lignin. In order to soften, defiber and open the fibers and make a pulp suitable for paper manufacturing, paper makers have subjected bagasse to severe treatment, e.g., a digestion at a high temperature in a solution containing alkali and/or sulfur compounds.

One illustration of the foregoing prior practice is disclosed in U.S. Pat. No. 3,738,908 issued to Eduardo J. Villavicencio. The process there disclosed includes prehydrolysis of bagasse at a temperature of between about 171° C. to 188° C. with resultant decomposition of the xylose, formation of furfural, and loss of xylose. Such severe treatment removes large amounts of lignin and most of the hemicellulose, and these substances are discarded as black liquor, representing a loss of valuable materials. The only product obtained from processing bagasse in this manner is pulp which can be used in making paper.

Where the digestion step in prior processes leaves an excessive hemicellulose content remaining in the fibers, paper made from the resultant pulp has the appearance of parchment and is brittle. On the other hand, if not enough of the gamma- and beta-cellulose remains with the fibers, a sheet of paper made from the pulp does not possess desired strength.

SUMMARY OF THE INVENTION

The present invention overcomes the foregoing and other drawbacks of the prior art and provides a new method of converting most of the gamma- and beta-cellulose in annual vascular plants containing holocellulose and lignin into sugars, such as pentoses and hexoses. The sugars may be used in making valuable chemical products including sweeteners, plasticizers, cattle feeds, humectants, surfactants, polyols, sequestering agents, emulsifiers, proteins, enzymes, antibiotics, vitamins and the like. At the same time the method retains variable predetermined amounts of the lignin in the pulp, equivalent to Kappa numbers between about 30 and about 50 or about 4.5% to about 7.5% by weight of lignin, for producing papers of different grades.

The present invention is preferably embodied in a two-step process. In the first step the annual vascular plants are subjected to a short retention time, low temperature, prehydrolysis treatment in steam and the vapor of a dilute acid solution with the resultant separation and recovery of much of the hemicellulose. In the second step residue from the first step is subjected to a short retention time digestion under pressure in an aqueous solution containing a small amount of alkali, with or without sulfur compounds, at a temperature low enough that the fibers are not degraded to an objectionable extent.

The present invention makes it possible to convert a low value material, specifically bagasse, into materials of high value for use in producing other products and into pulp which can be converted into various quality papers. The process of the present invention requires less water and energy than known processes, and operates without creating pollution problems, but obtains a higher recovery of fibers and pentoses and hexoses. Furthermore, the spent liquor from the digestion step, i.e., "black liquor," contains little or no hemicellulose, and has an enhanced heating value.

DESCRIPTION OF THE PREFERRED EMBODIMENT

The present invention will be better understood from Table I and the following description of the various steps and the results obtained therefrom in converting bagasse into sugars and pulp suitable for making paper.

The term "H" factor, as used herein, is an expression of cooking times and temperatures as a single variable (See Pulp and Paper Manufacture, Vol. 1, page 422 published in 1969 by McGraw Hill, New York).

The term "Kappa number," as used herein, is an indication of the hardness or bleachability of pulp and is an approximation of the lignin content in pulp. A Kappa number is the number of milliliters of 0.1000 N potassium permanganate consumed by 1.0 gram of pulp under certain conditions (See Standard G of the Physical and Chemical Standards Committee of the Canadian Paper and Pulp Association). A Kappa number may be converted into percentage of lignin by multiplying the number by 0.15. For example, a Kappa number of 40 is equivalent to a lignin content in the pulp of 6%.

The term "retention time", as used herein, refers to the duration of a time of heating at a specified temperature.

The term "active alkali", as used herein, is a concentration of NaOH plus $Na_2S$ expressed as $Na_2O$ (See Pulp and Paper Manufacture, Vol. 1, The Pulping of Wood, p. 360).

The term "sulfidity", as used herein, is a percentage ratio of $Na_2S$, expressed as $Na_2O$, to active alkali (See Ibid. p. 360).

The term "white liquor", as used herein, means a liquid containing "active alkali", as above defined with or without "sulfidity", as above defined. That liquor contains from about 10% to about 20% of active alkali, such as sodium oxide, with or without from about 5% to about 25% of sulfidity, such as sodium sulfide.

The term "black liquor", as used herein, means the black colored liquid resulting from the digestion step and containing much of the lignin content of the fibers.

The term "green liquor", as used herein, means the liquids made by dissolving the smelt from the recovery furnace (recovered chemicals) in water and weak liquor prior to causticizing (See Ibid. p. 225).

The present process may be carried out in the same general way on the several previously described annual vascular plants. The following description of that process as applied to bagasse is applicable to these several plants.

Bagasse is first reduced to short lengths, for example, lengths of 2 inches to 4 inches. It is then prehydrolyzed by being heated in steam in the vapor of a dilute aqueous acid solution under pressure. The prehydrolyzing temperature should range between about 105° C. and about 135° C., preferably about 125° C. The prehydrolyzing time should range between about 7 minutes and about 20 minutes, preferably about 5 minutes after which resulting liquid, containing pentoses and hexoses, is separated from the fibers. The dilute aqueous acid solution may contain one or more mineral acids or one or more organic acids or any combination of mineral and organic acids. The dilute acid solution should have a pH value between about 1.5 and about 3.5 and the weight ratio of acid solution to the dry bagasse should be about 3:1. The pressure under which the prehydrolysis takes place should not exceed about 34 pounds per square inch gage (psig). Exhaust steam may be used for such heating since it has pressures of about 45 psig, which can readily be reduced to acceptable pressures. Such use of exhaust steam is an important economic advantage of this invention.

A dilute aqueous acid solution which has been found to be satisfactory for the prehydrolyzing step contains by weight about 0.2% of hydrochloric acid, about 1.3% of formic acid and about 2.7% of acetic acid.

This prehydrolyzing step treatment is slightly exothermic and converts up to about 80° by weight of the hemicellulose into sugars, such as pentoses (mainly xylose), and hexoses. The sugars may be recovered by crystallization and converted into other valuable and saleable products.

The prehydrolyzing temperature should not exceed about 135° C. for, at higher temperatures, xylose dissociates in an acid solution. The rapidity of dissociation increases as temperature increases so that at a temperature of about 180° C. and with a solution containing about 0.8% by weight $H_2SO_4$, the half life of the xylose is only about 9.6 minutes. The dissociation of the xyloses is shown by the following equation:

$$\frac{C_5H_{10}O_5}{\text{xylose}} - \frac{3H_2O}{\text{water}} = \frac{C_5H_4O_2}{\text{furfural}}$$

Moreover, the cellulose fibers become degraded as the prehydrolyzing temperature increases above about 135° C.

After the sugars have been separated, much of the lignin is separated from the fibers and the fibers are opened or separated. This separating operation is known as digestion and is carried out by heating the fibers in "white liquor" which is an aqueous solution of an alkali with or without a sulfur compound e.g., at a white liquor to fibrous solid weight ratio of 6:1. The alkali may be sodium oxide, sodium carbonate or other similar alkali compounds and may range in amounts by weight of from about 10% to about 20% of the liquor. The sulfur compound may consist of sodium sulfide or other suitable sulfur compounds.

The digestion step is carried out at a temperature between about 105° C. and 135° C., preferably about 120° C., and at the equivalent saturated steam pressure for a short time, between about 15 minutes and about 55 minutes, preferably about 20 minutes, after which the fibers are separated from the liquor, screened to remove rejects, and washed free of the liquor.

In both the foregoing prehydrolyzing and digesting steps, the described times and temperatures may be varied independently of one another and generally in inverse ratio.

Results obtained were bagasse which has been prehydrolyzed as described and then subjected to the described heating or digesting treatment are presented in Table I.

TABLE I.

COOKING CONDITIONS AND PULP YIELDS OF LOW TEMPERATURE COOKS OF CONTROL AND PREHYDROLYZED BAGASSE

| | | | | Liquor | | | Yields (%) | | | |
|---|---|---|---|---|---|---|---|---|---|---|
| Sample Material | Max. Temp. (° C.) | Time at Max. temp. (min.) | "H" Factor | Active Alkalinity (%) | Sulfidity (%) | Liquor: Solid Ratio | Rejects | Screened | Total | Kappa No. |
| Prehydrolyzed | 120 | 15 | 4 | 15 | 25 | 6:1 | 2.9 | 46.9 | 49.8 | 43.9 |
| bagasse | 120 | 35 | 7 | 15 | 25 | 6:1 | 1.9 | 47.1 | 49.0 | 44.0 |
| | 120 | 55 | 10 | 15 | 25 | 6:1 | 1.2 | 45.8 | 47.0 | 40.8 |
| Prehydrolyzed | 120 | 15 | 4 | 12 | 25 | 6:1 | 7.2 | 48.2 | 55.4 | 55.7 |
| bagasse | 120 | 35 | 7 | 12 | 25 | 6:1 | 5.3 | 47.7 | 53.0 | 53.2 |
| | 120 | 55 | 10 | 12 | 25 | 6:1 | 4.6 | 47.9 | 52.5 | 53.6 |
| Prehydrolyzed | 130 | 15 | 11 | 15 | 0 | 6:1 | 1.2 | 43.5 | 44.7 | 39.4 |
| bagasse | 130 | 35 | 19 | 15 | 0 | 6:1 | 0.5 | 44.4 | 44.9 | 31.1 |
| | 130 | 55 | 27 | 15 | 0 | 6:1 | 0.6 | 43.8 | 44.4 | 30.0 |
| Prehydrolyzed | 130 | 15 | 11 | 12 | 0 | 6:1 | 1.5 | 46.2 | 47.7 | 44.3 |
| bagasse | 130 | 35 | 19 | 12 | 0 | 6:1 | 1.8 | 45.6 | 47.4 | 40.5 |
| | 130 | 55 | 27 | 12 | 0 | 6:1 | 1.2 | 44.6 | 45.8 | 40.5 |
| Prehydrolyzed | 112 | 15 | 1.6 | 15 | 25 | 6:1 | 4.7 | 47.9 | 52.6 | 51.3 |
| bagasse | 112 | 35 | 3 | 15 | 25 | 6:1 | 3.0 | 48.3 | 51.3 | 48.5 |
| | 112 | 55 | 4 | 15 | 25 | 6:1 | 2.3 | 46.0 | 48.3 | 45.4 |
| Prehydrolyzed | 112 | 15 | 1.6 | 15 | 0 | 6:1 | 4.7 | 47.9 | 52.6 | 49.2 |
| bagasse | 112 | 35 | 3 | 15 | 0 | 6:1 | 2.5 | 47.8 | 50.3 | 47.8 |
| | 112 | 55 | 4 | 15 | 0 | 6:1 | 1.3 | 47.2 | 48.5 | 44.0 |
| Control | 120 | 15 | 4 | 15 | 25 | 6:1 | 14.1 | 49.3 | 63.4 | 43.3 |
| bagasse | 120 | 35 | 7 | 15 | 25 | 6:1 | 12.2 | 48.5 | 60.7 | 37.4 |
| | 120 | 55 | 10 | 15 | 25 | 6:1 | 9.1 | 51.2 | 60.3 | 36.7 |
| Control | 120 | 15 | 4 | 15 | 0 | 6:1 | 15.4 | 45.4 | 60.8 | 42.5 |
| bagasse | 120 | 35 | 7 | 15 | 0 | 6:1 | 10.7 | 46.8 | 57.5 | 37.9 |
| | 120 | 55 | 10 | 15 | 0 | 6:1 | 8.7 | 48.4 | 57.1 | 34.5 |
| Control | 105 | 15 | | 15 | 0 | 6:1 | 23.86 | 38.23 | 62.09 | 52.9 |
| bagasse | 105 | 35 | | 15 | 0 | 6:1 | 20.54 | 40.55 | 61.09 | 45.0 |
| | 105 | 55 | | 15 | 0 | 6:1 | 10.46 | 46.99 | 57.45 | 39.8 |

TABLE I.-continued

COOKING CONDITIONS AND PULP YIELDS OF LOW TEMPERATURE COOKS OF CONTROL AND PREHYDROLYZED BAGASSE

| Sample Material | Max. Temp. (° C.) | Time at Max. temp. (min.) | "H" Factor | Liquor: Active Alkalinity (%) | Liquor: Sulfidity (%) | Liquor: Solid Ratio | Yields (%): Rejects | Yields (%): Screened | Yields (%): Total | Kappa No. |
|---|---|---|---|---|---|---|---|---|---|---|
| Prehydrolyzed bagasse | 105 | 15 | | 15 | 0 | 6:1 | 7.05 | 46.19 | 53.24 | 55.3 |
| | 105 | 35 | | 15 | 0 | 6:1 | 3.43 | 46.01 | 49.44 | 51.1 |
| | 105 | 55 | | 15 | 0 | 6:1 | 1.91 | 46.67 | 48.58 | 50.9 |

Table I presents numerous conditions under which prehydrolyzed bagasse was digested and the results obtained with each set of conditions. For example, prehydrolyzed bagasse heated under pressure at a temperature of about 112° C. for 15 minutes at an "H" factor of 1.6 in a 15% solution of sodium oxide gave 4.7% of rejected fibers and 47.9% of screened fibers with a "Kappa" number of 4.2. Similarly, prehydrolyzed bagasse heated under pressure at about 130° C. for 15 minutes at an H factor of 11 in an aqueous solution containing 15% of sodium oxide resulted in 1.2% of rejected fibers and 43.5% of screened fibers, with a "Kappa" number of 39.4. Kappa numbers from 44 to 49 are equivalent to about 6.6 to about 7.4% of lignin in the pulp.

Heretofore it has been thought that a digestion temperature below 170° C. gave no advantage in either yield or utility and that above about 180° C. the cellulose became increasingly susceptible to degradation. Accordingly, temperatures of from 170° C. to 180° C. have been common in commercial practice.

In contrast, as shown by Table I, bagasse prehydrolyzed by the described treatment and digested at a temperature of 170° C. for 15 minutes in a 12% sodium oxide solution at an "H" factor of 342 gave 43.62% of rejected fibers, 36.24% of screened fibers and a Kappa number of 130.

The present invention may be carried out by means of suitable conventional apparatus. Apparatus which has been employed in practicing the present invention includes a closable vessel which retains steam at a pressure of 45 psig and is connected to a source of steam and a source of dilute acid. A similar vessel and steam source and means for heating the vessel and its contents were used for the digesting step.

Having thus described this invention in such full, clear, concise and exact terms as to enable any person skilled in the art to which it pertains to make and use the same, and having set forth the best mode contemplated of carrying out this invention, I state that the subject matter which I regard as being my invention is particularly pointed out and distinctly claimed in what is claimed, it being understood that equivalents or modifications of, or substitutions for, parts of the above specifically described embodiments of the invention may be made without departing from the scope of the invention as set forth in what is claimed. It is intended that the patent shall cover, by suitable expression in the claims, whatever features of patentable novelty exist in the invention disclosed.

1. A method for treating annual, vascular plant material containing hemicellulose and lignin which comprises the steps of:

a. prehydrolyzing said plant material by heating said plant material under pressure in the presence of steam and the vapors of a dilute acid solution having a pH in the range from 1.5 to about 3.5 at a temperature ranging between about 105° C. and about 135° C. for between 7 minutes and about 20 minutes to hydrolyze at least a portion of said hemicellulose into pentoses and hexoses and to leave a fibrous material and a liquid, said liquid containing said pentoses and hexoses;

b. separating said liquid from said fibrous material, and recovering the pentoses and hexoses from said liquid;

c. heating said fibrous material under pressure in the presence of white liquor at a temperature ranging between about 105° C. and about 135° C. for a time sufficient to digest said fibrous material;

d. separating the digested fibrous material from spent digestion liquor; and then e. washing the digested fibrous material.

2. The method set forth in claim 1 in which the prehydrolysis is performed at a weight ratio of acid solution to plant material of about 3:1.

3. The method set forth in claim 2 in which the weight ratio of white liquor to fibrous material is about 6:1 and said digestion is completed in from 15 to about 55 minutes.

4. The method set forth in claim 1 in which the acid solution of the prehydrolyzing step contains about 0.2% by weight of hydrochloric acid, about 1.3% by weight of formic acid and about 2.7% by weight of acetic acid.

5. The method set forth in claim 1 in which said white liquor to fibrous material weight ratio is about 6:1.

6. The method set forth in claim 1 in which the heating time of the digestion step is between about 15 minutes and about 55 minutes.

7. The method set forth in claim 1 in which the digestion step is carried out in an aqueous solution containing between about 12% and about 15% by weight of active alkali.

8. The method set forth in claim 1 in which the digestion step is carried out in an aqueous solution containing between about 12% and about 15% by weight of active alkali and having a sulfidity of about 25%.

9. The method set forth in claim 1 in which said annual, vascular plant material is bagasse.

10. The method set forth in claim 1 wherein said plant material is prehydrolyzed at 125° C. for about 15 minutes and said fibrous material is digested at about 120° C. for about 20 minutes.

11. The method set forth in claim 1 wherein said dilute acid solution contains an acid selected from the group consisting of organic acids, mineral acids, and mixtures thereof.

12. The method set forth in claim 1 wherein the active alkali in said white liquor is selected from the group consisting of sodium oxide and sodium carbonate.

13. In a method for prehydrolyzing and digesting annual, vascular plants containing hemicellulose and lignin including the steps of prehydrolyzing said plants in an acidic aqueous medium under pressure in the presence of steam resulting in a fibrous material and a liquid, said liquid containing pentoses and hexoses, and digesting the resulting fibrous material in an aqueous alkaline medium containing sulfide values therein, the improvement comprising:

prehydrolyzing said plants in contact with the vapors of a dilute acid solution having a pH in the range from 1.5 to about 3.5 at a temperature in the range from 105° C. to about 135° C. for from about 7 to 20 minutes to convert at least a portion of said hemicellulose to pentoses and hexoses, separating said liquid from said fibrous material prior to digesting said fibrous material and recovering said pentoses and hexoses from said liquid.

* * * * *

UNITED STATES PATENT OFFICE

CERTIFICATE OF CORRECTION

PATENT NO. : 4,070,232

DATED : January 24, 1978

INVENTOR(S) : Harald F. Funk

It is certified that error appears in the above-identified patent and that said Letters Patent are hereby corrected as shown below:

Column 3, line 37, delete "80°" and substitute --80%--.

Column 5, line 18, delete "4.2" and substitute --49.2--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*